US005786736A

United States Patent [19]

Dejima et al.

[11] Patent Number: 5,786,736

[45] Date of Patent: Jul. 28, 1998

[54] NON-RECIPROCAL CIRCUIT ELEMENT

[75] Inventors: Hiroki Dejima; Takashi Hasegawa; Yutaka Ishiura; Yoshikazu Chigodou; Hiroshi Matsui; Keiji Ogawa, all of Nagaokakyo, Japan

[73] Assignee: Murata Manufacturing Co., Ltd., Japan

[21] Appl. No.: 713,977

[22] Filed: Sep. 13, 1996

Related U.S. Application Data

[63] Continuation of Ser. No. 381,837, PCT/JP94/01059 filed on Jun. 29, 1994, abandoned.

[30] Foreign Application Priority Data

Jun. 30, 1993 [JP] Japan ..... 5-161736

[51] Int. Cl.[6] ..... H01P 1/383

[52] U.S. Cl. ..... 333/1.1; 333/24.2

[58] Field of Search ..... 333/1.1, 24.1, 333/24.2

[56] References Cited

U.S. PATENT DOCUMENTS

| | | | |
|---|---|---|---|
| 3,614,675 | 10/1971 | Konishi | 333/1.1 X |
| 4,016,510 | 4/1977 | Hodges, III et al. | 333/24.2 |
| 5,017,894 | 5/1991 | Naito | 333/1.1 |
| 5,159,294 | 10/1992 | Ishikawa et al. | 333/1.1 |
| 5,419,947 | 5/1995 | Dejima et al. | 333/1.1 X |

FOREIGN PATENT DOCUMENTS

| | | | |
|---|---|---|---|
| 44-27528 | 11/1969 | Japan . | |
| 2-203602 | 8/1990 | Japan . | |
| 2-134711 | 11/1990 | Japan . | |
| 3-86608 | 9/1991 | Japan . | |
| 4-25302 | 2/1992 | Japan . | |
| 5-136572 | 6/1993 | Japan . | |
| 304404 | 11/1993 | Japan | 333/1.1 |
| 5-299904 | 11/1993 | Japan . | |

*Primary Examiner*—Paul Gensler

*Attorney, Agent, or Firm*—Ostrolenk, Faber, Gerb & Soffen, LLP

[57] ABSTRACT

A non-reciprocal circuit element which can be miniaturized while still providing a matching capacitance having a large value. A circulator, for example, has central electrodes and a multilayer substrate for forming a matching capacitance. The multilayer substrate is formed by stacking a plurality of dielectric sheets provided with central electrodes or matching capacitive electrodes with each other and integrally firing the same. The matching capacitance is formed by connecting multilayer capacitive parts which are formed by stacking a number of dielectric sheets which are each partially sandwiched by a pair of capacitive electrodes in parallel with each other. An upper surface of the multilayer substrate has a first aperture for receiving a ferrite member and a second aperture for receiving a permanent magnet in positions facing the central electrodes.

13 Claims, 8 Drawing Sheets

NON-RECIPROCAL CIRCUIT ELEMENT

This is a Continuation of application Ser. No. 08/381,837, filed as PCT/JP94/01059 filed on Jun. 29, 1994, now abandoned.

INDUSTRIAL FIELD

The present invention relates to a non-reciprocal circuit element for being employed in the VHF, UHF and SHF bands such as a circulator or an isolator, for example, and more particularly, it relates to a structure which can be miniaturized and reduced in weight and cost.

BACKGROUND

In general, a non-reciprocal element such as an isolator or a circulator having a function of passing signals only in a transmission direction and preventing the same from transmission in another direction is indispensable for a transmission circuit part of a mobile communication device such as a portable telephone or a car telephone. In such application, miniaturization and weight reduction are required for the non-reciprocal element. Further, cost reduction is also required in order to increase the demand for the part. In order to satisfy such requirements, there has been proposed a non-reciprocal element provided with central electrodes, matching circuit electrodes and other elements which are compactly arranged on dielectric substrates. FIGS. 8 and 9 show an exemplary circulator 100 having such a structure. FIG. 9 illustrates a sectional structure of the circulator, and FIG. 8 mainly shows structures of dielectric substrates. The conventional circulator 100 comprises dielectric substrates 107 to 109, a ferrite member 104 and a magnet 106 which are arranged in a metal yoke 101. The ferrite member 104 is connected to a bottom surface of the yoke 101 by means of an earth plate 105. The dielectric substrates 107 to 109 are arranged in such positions that central electrodes 102 provided thereon face the ferrite member 104. Further, the magnet 106 is attached to an inner upper surface of the yoke 101 to face the central electrodes 102. This magnet 106 applies a dc magnetic field to the central electrodes 102.

As shown in FIG. 8, the central electrodes 102, capacitive electrodes 110 and earth electrodes 111 are formed in a laminate of the three dielectric substrates 107 to 109. Such a multilayer substrate is manufactured through the following steps: First, ceramic green sheets are fired to form the respective substrates 107 to 109, and thereafter the central electrodes 102, the capacitive electrodes 110 and the earth electrodes 111 are pattern-formed on first major surfaces of the respective substrates 107 to 109, while earth electrodes 112 are pattern-formed on second major surfaces and baked. Then, the dielectric substrates 107 to 109 provided with the electrodes are stacked and compression-bonded to each other. Further, the earth electrodes 111 and 112 are connected with each other by through-hole electrodes 113. The capacitive electrodes 110 are provided with external electrodes 114, which are connected with input/output terminals. In such a multilayer structure, a matching capacitance is formed by the capacitive electrodes 110, the dielectric substrates 107 to 109 and the earth electrodes 112.

In the conventional circulator, the matching capacitance is formed around the three central electrodes 102 intersecting with each other, thereby miniaturizing the overall part.

In the aforementioned structure, however, miniaturization of the part is restricted because of the need to obtain a sufficient capacitance value of the matching capacitance. Namely, the capacitance value of the matching capacitance is defined by opposition areas of the capacitive electrodes 110 and the earth electrodes 112. If the required capacitance value is increased, therefore, electrode areas of the capacitive electrodes 110 must be increased. Thus, the substrate areas of the dielectric substrates 107 to 109 are also increased, leading to an increase of the overall part size. In other words, miniaturization of the part size is restricted by the required capacitance value.

Further, the conventional structure requires two firing steps for firing the ceramic green sheets and for baking the patterned electrodes on the substrates, leading to an increase in manufacturing cost. Further, a complicated assembling operation of positioning and fixing the magnet 106, the ferrite member 104 and the like in the yoke 101 independently of each other also leads to an increase in manufacturing cost.

OBJECT OF THE INVENTION

An object of the present invention is to provide a non-reciprocal element which can be reduced in part size.

DISCLOSURE OF THE INVENTION

According to a broad aspect of the present invention, a non-reciprocal element comprises a multilayer substrate formed by stacking a plurality of dielectric layers with each other, a plurality of central electrodes which are provided in the multilayer substrate to intersect with each other while being electrically insulated from each other, a matching capacitance provided by a plurality of capacitive parts which are stacked in the multilayer substrate to be connected to said central electrodes, a magnetic body such as a ferrite body which is provided to face the central electrodes, and a magnet for applying a dc magnetic field to the magnetic body and the central electrodes.

According to such a structure, it is possible to ensure a necessary capacitance value for the matching capacitance by properly setting the number of capacitive parts which are stacked in the multilayer substrate. Thus, it is possible to increase the capacitance value of the matching capacitance without increasing the area of the multilayer substrate in a plane region. Consequently, it is possible to reduce the planar size of the non-reciprocal circuit element, thereby miniaturizing the part.

Another object of the present invention is to provide a non-reciprocal circuit element of which the part size as well as the part cost can be reduced.

In a non-reciprocal circuit element according to another aspect of the present invention, a multilayer substrate is formed by integrally firing a plurality of dielectric layers which are stacked with each other.

According to such a structure, the multilayer substrate is integrally formed through a single firing step. Thus, the number of firing steps is reduced as compared with the aforementioned conventional non-reciprocal circuit element, whereby the manufacturing cost is reduced.

In the non-reciprocal circuit element according to this aspect of the present invention, a first holding portion is formed in the multilayer substrate for holding a magnetic body in a position facing the central electrodes, so that the magnetic body is held by this first holding portion.

According to this structure, it is possible to automatically set the relative position of the magnetic body with respect to the central electrodes by mounting the same on the first holding portion of the multilayer substrate. Thus, it is possible to omit a complicated positioning step, thereby reducing the manufacturing cost.

In the non-reciprocal circuit element according to this aspect of the present invention, further, a second holding portion is formed in the multilayer substrate for holding a magnet in a position facing the central electrodes, so that the magnet is held by this second holding portion.

According to this structure, it is possible to automatically set the positional relation between the magnet and the central electrodes by mounting the magnet on the second holding portion of the multilayer substrate. Thus, it is possible to omit a complicated positioning step, thereby reducing the manufacturing cost.

The aforementioned central electrodes in the present invention may be formed in different vertical positions in the multilayer substrate. In this case, the aforementioned plurality of central electrodes may be formed on different dielectric layer surfaces when the multilayer substrate is obtained by an integral firing technique.

Further, the aforementioned central electrodes may be so formed as to have first central electrode portions which are arranged on one surface of one dielectric layer in the substrate, second central electrode portions which are arranged on another surface, and through-hole conductive portions which are formed in the dielectric layer for electrically connecting the first and second central electrode portions with each other. In this case, the aforementioned through-hole conductive portions may be formed in one dielectric layer so that the first and second central electrode portions are formed on upper and lower surfaces of the dielectric layer, or the first central electrode portions may be formed on one surface of a dielectric layer provided with the through-hole conductive portions so that the second central electrode portions are formed on one surface of another dielectric layer which is in contact with another surface of the dielectric layer, when the multilayer substrate is formed by the integral firing technique.

The foregoing and other objects, features, aspects and advantages of the present invention will become more apparent from the following detailed description of embodiments of the present invention when taken in conjunction with the accompanying drawings.

BEST MODES FOR CARRYING OUT THE INVENTION

Embodiments of the non-reciprocal element according to the present invention are now described with reference to the accompanying drawings, to clarify the present invention.

First Embodiment

Figure 1:
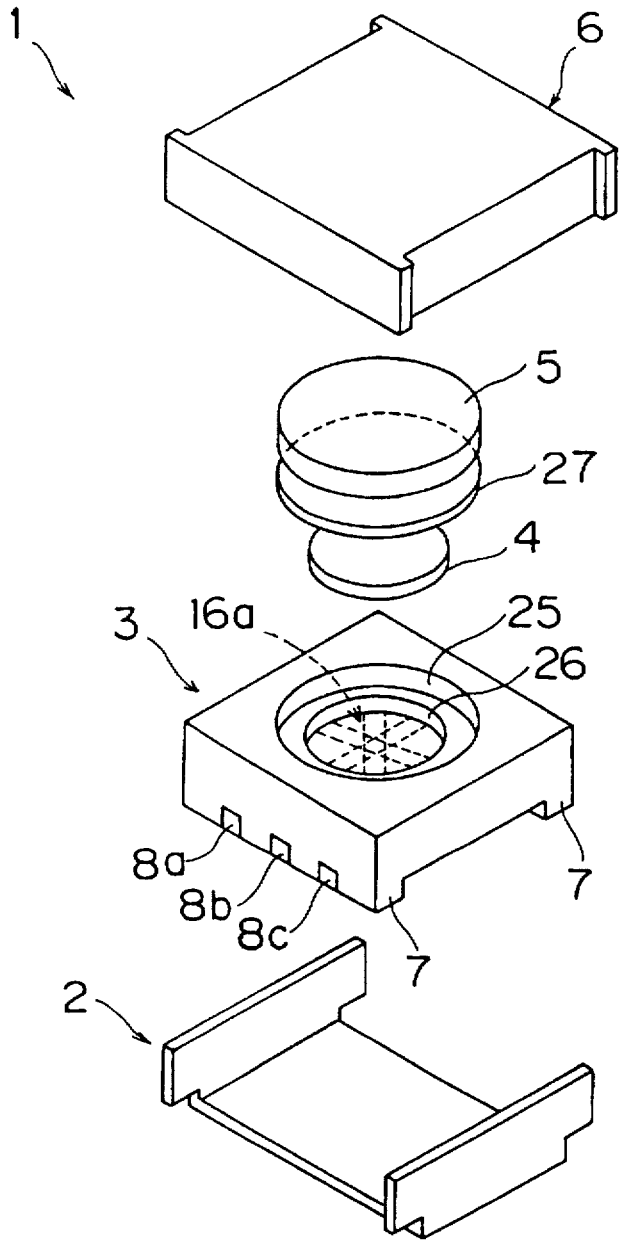
FIG. 1 is an exploded perspective view showing the structure of a circulator according to a first embodiment of the present invention.
Figure 2:
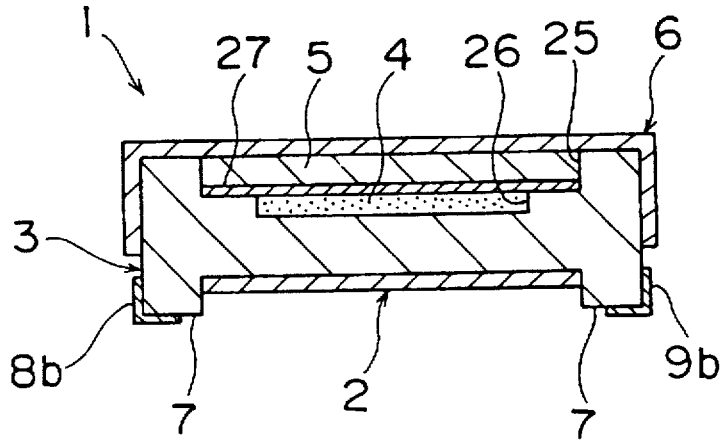
FIG. 2 is a sectional view showing the structure of the circulator appearing in FIG. 1.

FIGS. 1 to 4 show the structure of a lumped parameter circulator 1 according to a first embodiment of the present invention. Referring to FIG. 1, the circulator 1 has a multilayer substrate 3, a lower yoke 2 and an upper yoke 6. The lower and upper yokes 2 and 6 are prepared from a magnetic metal in the form of boxes enclosing the multilayer substrate 3 along the vertical direction.

The multilayer substrate 3 has a first aperture 26 for receiving a ferrite member 4 and a second aperture 25 for receiving a permanent magnet 5 in an upper portion which is close to the upper yoke 6, while projections 7 are formed on both ends of the multilayer substrate 3 which are close to the lower yoke 2. The projections 7 project from clearances between the upper and lower yokes 6 and 2, to expose external electrodes 8*a* to 8*c* serving as input/output terminals, external electrode 9*b* (FIG. 2) serving as an earth terminal, and other earth terminals not shown. When the circulator 1 is mounted on a circuit board, the external electrodes 8*a* to 8*c* and 9*b* and the other electrodes not shown are connected to electrode lines which are provided on this circuit board.

The ferrite member 4 is mounted in the first aperture 26 of the multilayer substrate 3. On the other hand, the permanent magnet 5 is mounted in the second aperture 25 which is located above the ferrite member 4, with interposition of an earth plate 27.

Figure 3:
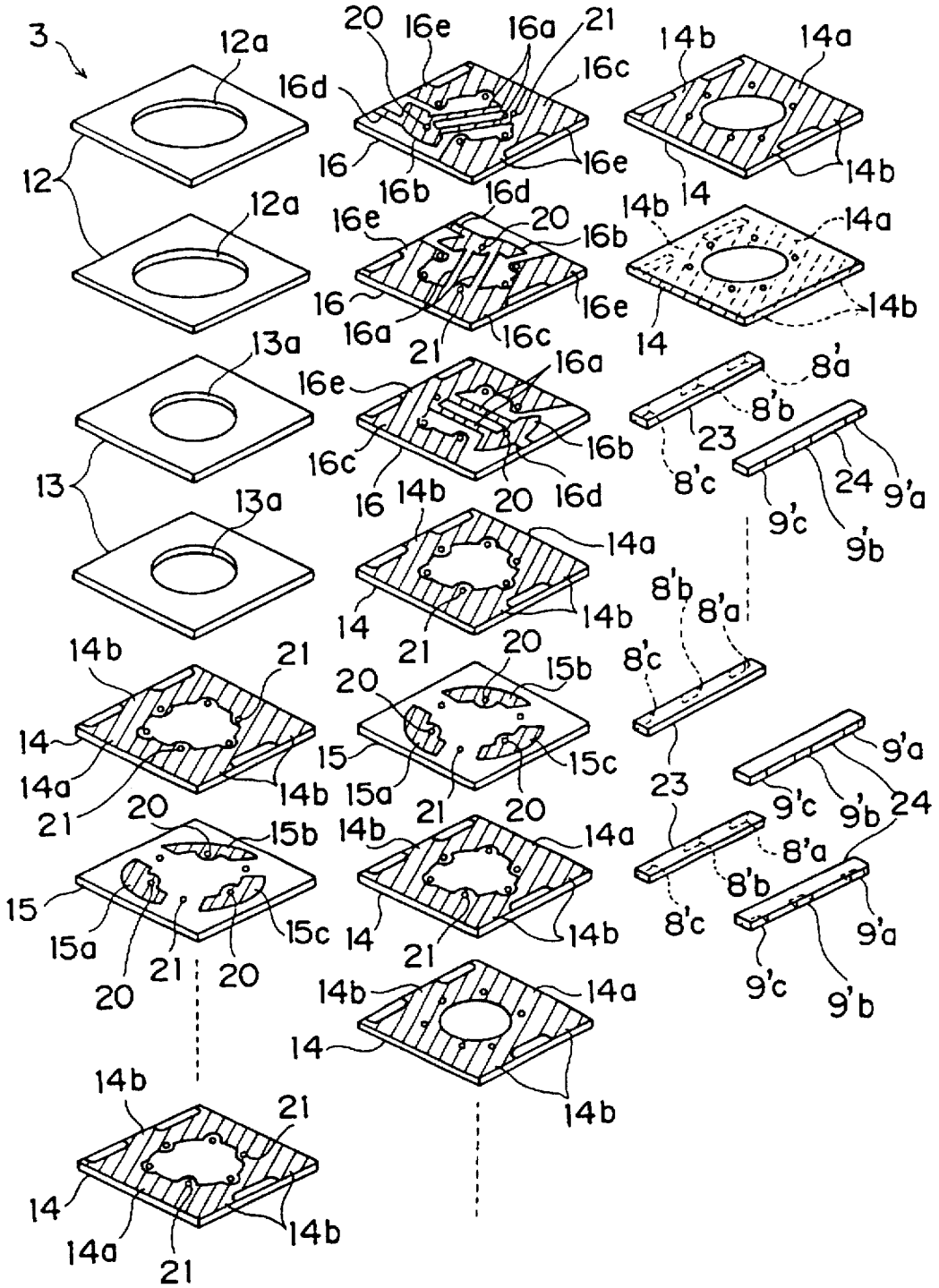
FIG. 3 is an exploded perspective view showing the structure of a multilayer substrate provided in the circulator according to the first embodiment of the present invention.
Figure 4:
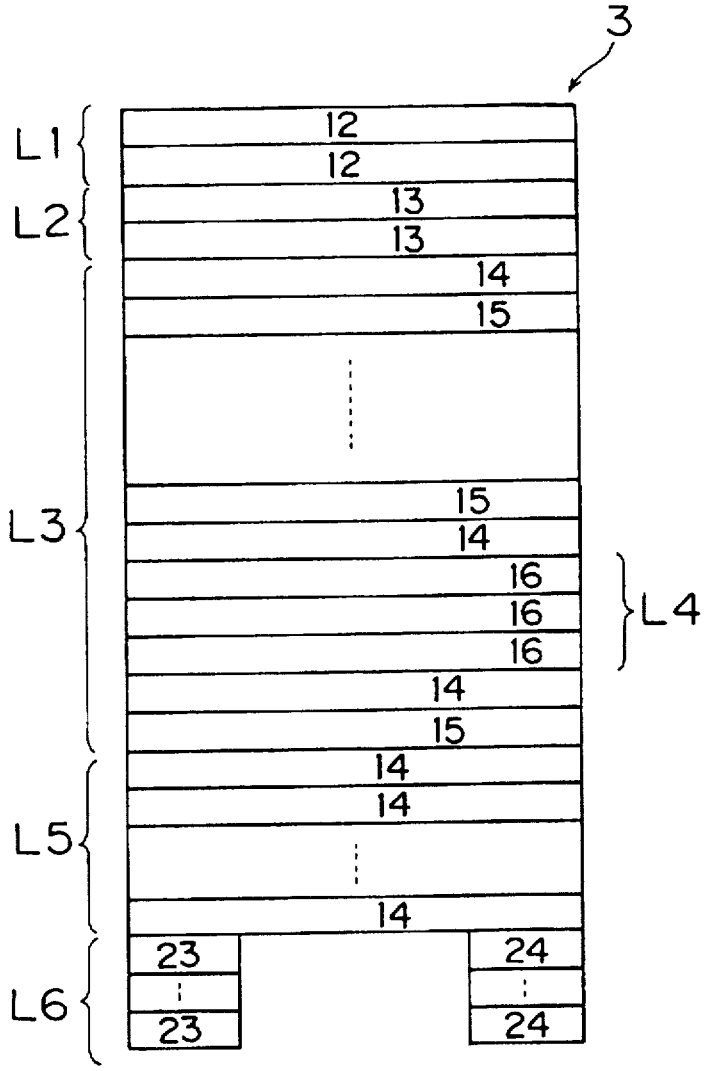
FIG. 4 is an explanatory diagram for illustrating the structure of the multilayer substrate shown in FIG. 3.

As shown in FIGS. 3 and 4, the multilayer substrate 3 is a sintered body which is formed by integrally firing a number of dielectric layers, and respective electrodes are buried in this sintered body. The dielectric layers which are still in unfired states are denoted by reference numerals for convenience of illustration of the respective portions. Referring to FIG. 4, the multilayer substrate 3 is mainly classified into six layers L1 to L6. The first layer L1, having the second aperture 25 for receiving the permanent magnet 5, is formed by two first dielectric sheets 12, for example. The first dielectric sheets 12 are provided in central portions thereof with holes 12*a* which are sized to be capable of receiving the permanent magnet 5.

The second layer L2, which is provided with the first aperture 26 for receiving the ferrite member 4, is formed by two second dielectric sheets 13, for example. The second dielectric sheets 13 are provided in central portions thereof with holes 13*a* which are sized to be capable of receiving the ferrite member 4.

The third layer L3, which is mainly adapted to form a matching capacitance, is formed by alternately stacking a plurality of sets of third dielectric sheets 14 provided with earth electrodes 14*a* and fourth dielectric sheets 15 provided with capacitive electrodes 15*a* to 15*c*. Each earth electrode 14*a* is formed substantially on the overall surface of each third dielectric sheet 14 excluding its central portion, and has an externally extended portion 14*b* provided on one side edge of the third dielectric sheet 14 and two externally extended portions 14*b* provided on another side edge. These externally extended portions 14*b* are connected to the external electrodes 8*b*, 9*a* and 9*c* respectively.

The capacitive electrodes 15*a* to 15*c* are uniformly arranged on the surface of each fourth dielectric sheet 15 at intervals of 120°. A single capacitive electrode such as the electrode 15*a*, for example, is combined with a single dielectric sheet 14 or 15 and a single earth electrode 14*a*, to form a single capacitive part. A number of such capacitive parts are stacked in this third layer L3. The number of the capacitive parts to be stacked with each other is set in response to the capacitance value of the matching capacitance as required.

The fourth layer L4 is formed by three fifth dielectric sheets 16 provided with central electrodes 16*a*. The fifth dielectric sheets 16 also serve as dielectric sheets forming the aforementioned capacitive parts. Each central electrode 16*a* has two lines extending on a central portion of the surface of each fifth dielectric sheet 16 in parallel with each other. The central electrodes 16*a* provided on the three fifth dielectric sheets 16 are arranged to intersect with each other at angles of 120°. A single capacitive electrode 16*b* forming the aforementioned single capacitive part is connected to an end of each central electrode 16*a*. The other end of each central electrode 16*a* is connected to an earth electrode 16*c*.

The respective capacitive electrodes 16*b* are provided with externally extended electrodes 16*d*, which are connected with the external electrodes 8*a*, 8*c* and 9*b* respectively. Further, externally extended portions 16*e* which are provided on the earth electrodes 16*c* are connected to the external electrodes 8*b*, 9*a* and 9*c* respectively.

In the fifth layer L5, a plurality of fourth dielectric sheets 14 provided with earth electrodes 14*a* are stacked with each other. The lowermost fourth dielectric sheet 14 is so stacked as to downwardly direct its earth electrode 14*a*.

In the sixth layer L6 forming the two projections 7, a plurality of strip-shaped ceramic sheets 23 and 24 are stacked with each other. The ceramic sheets 23 and 24 are provided on outer side surfaces thereof with electrodes 8*a*' to 8*c*' and 9*a*' to 9*c*' corresponding to the external electrodes 8*a* to 8*c* and 9*a* to 9*c* respectively.

In the aforementioned structure, the plurality of capacitive electrodes 15*a* and 16*b* which are provided in the third layer L3 are connected with each other along the direction of stacking via through-hole electrodes 20. Similarly, the capacitive electrodes 15*b* and 16*b* as well as 15*c* and 16*b* are connected with each other along the direction of stacking via the through-hole electrodes 20 respectively. Further, the plurality of earth electrodes 14*a* are connected with each other along the direction of stacking via through-hole electrodes 21. Due to such connection, the respective capacitive parts which are formed in the third layer L3 are connected in parallel with each other and to each central electrode 16*a*, to form the matching capacitance.

The electrodes 8*a*, 8*c* and 9*b* which are formed in the sixth layer L6 are connected to the capacitive electrodes 16*d* respectively.

The multilayer substrate 3 having the aforementioned structure is manufactured in the following manner: First, flexible ceramic green sheets are formed by extrusion molding, for example, from a slurry prepared by mixing dielectric ceramic powder with an organic binder or the like, and cut into prescribed dimensions. Then, electrodes of Pd, Pt or Ag are pattern-formed on surfaces of the ceramic green sheets which are in the form of rectangular plates having thicknesses of about several 10 μm by printing or vapor deposition. Then, the respective dielectric sheets are stacked in the order shown in FIG. 3 or 4 and compression-bonded to each other, and fired at a high temperature to form a laminate. The ceramic sheets 23 and 24 for forming the projections 7 are also fired at the same time. Thus, the multilayer substrate 3 is formed by the dielectric sheets and the electrodes which are fired integrally with each other.

The first and second apertures 26 and 25 for receiving the permanent magnet 5 and the ferrite member 4 may be formed in the ceramic green sheets in advance of firing, or the upper surface of the multilayer substrate 3 formed by integral firing may be cut to define the apertures 25 and 26.

In assembling steps, the ferrite member 4, the earth plate 27 and the permanent magnet 5 are first inserted in the first and second apertures 26 and 25 of the multilayer substrate 3, and thereafter the lower and upper yokes 2 and 6 are assembled therewith to complete the circulator 1 having the aforementioned structure. The ferrite member 4 and the permanent magnet 5 are automatically located in prescribed positions facing the central electrodes 16*a*, by the previously formed first and second apertures 26 and 25. The permanent magnet 5 applies a dc magnetic field to the central electrodes 16*a*.

The circulator 1 according to this embodiment has the following characteristics:

(1) The matching capacitance is formed by connecting the plurality of capacitive parts which are stacked in the third layer L3 of the multilayer substrate 3 in parallel with each other. Therefore, it is possible to provide an increase of the capacitance value as required by increasing the number of the capacitive parts which are stacked with each other. In this case, the overall thickness of the multilayer substrate 3 is increased at an extremely small rate as the capacitance is increased, since each of the dielectric sheets forming the capacitive parts are merely several tens of μm in thickness. Thus, it is possible to reduce planar areas of the capacitive electrodes 15*a* and 16*b* forming the capacitive parts, thereby remarkably contributing to miniaturization of the part.

(2) The multilayer substrate 3 is manufactured by pattern-forming prescribed electrodes on the surfaces of a plurality of ceramic green sheets and integrally firing the same. Thus, it is possible to reduce the number of firing steps as compared with the aforementioned prior art requiring two firing steps, thereby reducing the manufacturing cost.

(3) It is possible to position the ferrite member 4 and the permanent magnet 5 by simply inserting the same in the first and second apertures 26 and 25 which are previously formed in the upper surface of the multilayer substrate 3. Therefore, it is possible to substantially omit a step of positioning the ferrite member or the permanent magnet dissimilarly to the prior art, thereby simplifying the assembling steps. The manufacturing cost can be reduced also by this.

(4) The first aperture 26 for receiving the ferrite member 4 and the second aperture 25 for receiving the permanent magnet 5 are coaxially formed in the upper surface of the multilayer substrate 3 in continuation. Thus, the permanent magnet 5 and the ferrite member 4 are arranged in proximity to each other. In general, the magnetic field of such a permanent magnet 5 is outwardly spread, and hence the magnetic flux is non-densified as the distance between the permanent magnet 5 and the ferrite member 4 is increased and densified as the distance is reduced. In the structure of this embodiment having the permanent magnet 5 and the ferrite member 4 which are in proximity to each other, therefore, the magnetic flux is so densified that the permanent magnet 5 may have weaker magnetic force as compared with that in the prior art, to serve an equivalent function.

Second Embodiment

Figure 5:
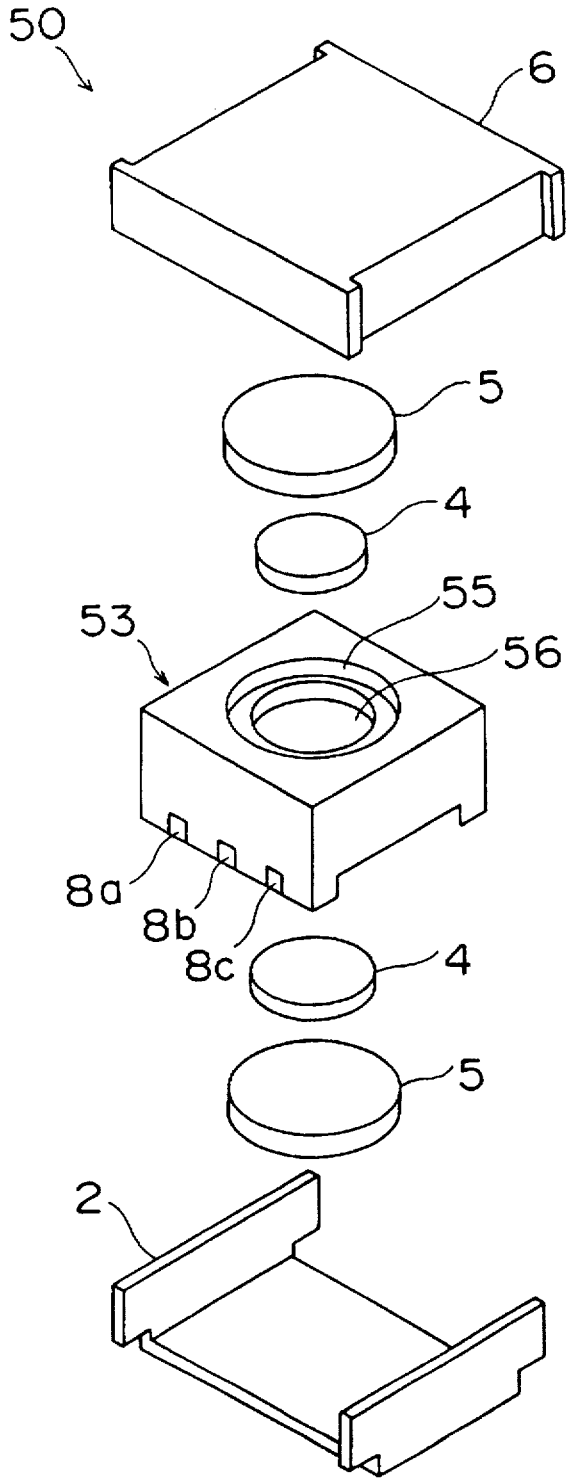
FIG. 5 is an exploded perspective view showing the structure of a circulator according to a second embodiment of the present invention.
Figure 6:
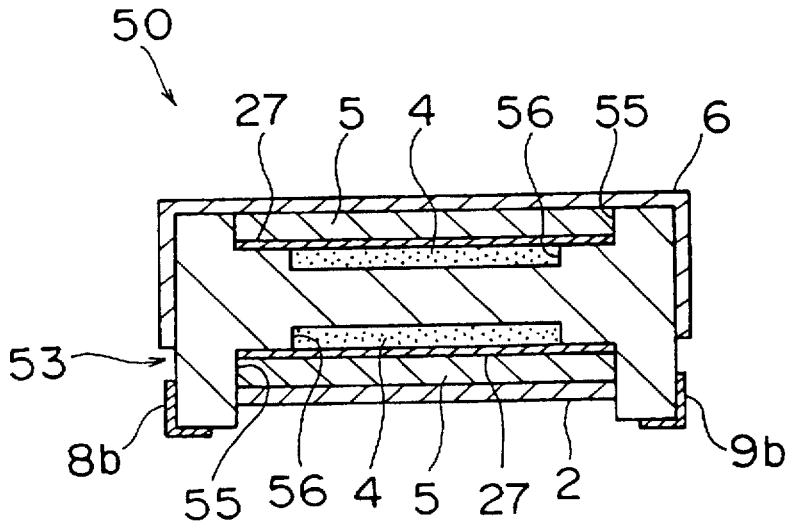
FIG. 6 is a sectional view showing the structure of the circulator according to the second embodiment of the present invention.

A circulator according to a second embodiment of the present invention is different in a state of arrangement of ferrite members 4 and permanent magnets 5 as compared with that in the circulator 1 according to the first embodiment. As shown in FIGS. 5 and 6, this circulator 50 has two second apertures 55 for receiving respective permanent magnets 5 and two first apertures 56 for receiving respective ferrite members 4 in upper and lower surfaces of a multilayer substrate 53 facing central electrodes (not shown) respectively. The permanent magnets 5 are mounted in the respective second apertures 55, while the ferrite members 4 are mounted in the respective first apertures 56 with interposition of earth plates 27. Due to this structure, the respective central electrodes provided in the multilayer substrate 53 are sandwiched by the pair of ferrite members 4, to be supplied with bias magnetic fields by the pair of permanent magnets 5 from both their upper and lower sides. According to this structure, it is possible to further reduce insertion loss as compared with the circulator 1 according to the first embodiment, in particular. Further, the advantages described with reference to the first embodiment can be similarly obtained.

While each of the first and second embodiments has been described with reference to a circulator serving as a non-reciprocal circuit element, the inventive structure is also applicable to an isolator. When the present invention is applied to an isolator, a terminating resistance is connected to any one of the externally extended electrodes 16*d* of the three central electrodes 16*a*.

While the respective capacitive electrodes and the earth electrodes provided in the multilayer substrate 3 are connected with each other via the through-hole electrodes in the aforementioned first embodiment, these electrodes may alternatively be connected with each other by electrodes which are formed on side surfaces of the dielectric sheets, in place of the through-hole electrodes.

Modification

While the plurality of central electrodes are formed on different dielectric layers in the second embodiment, it is also possible to form the plurality of central electrodes in the present invention on the same dielectric sheet. Such a modification is described with reference to FIG. 7.

Figure 7:
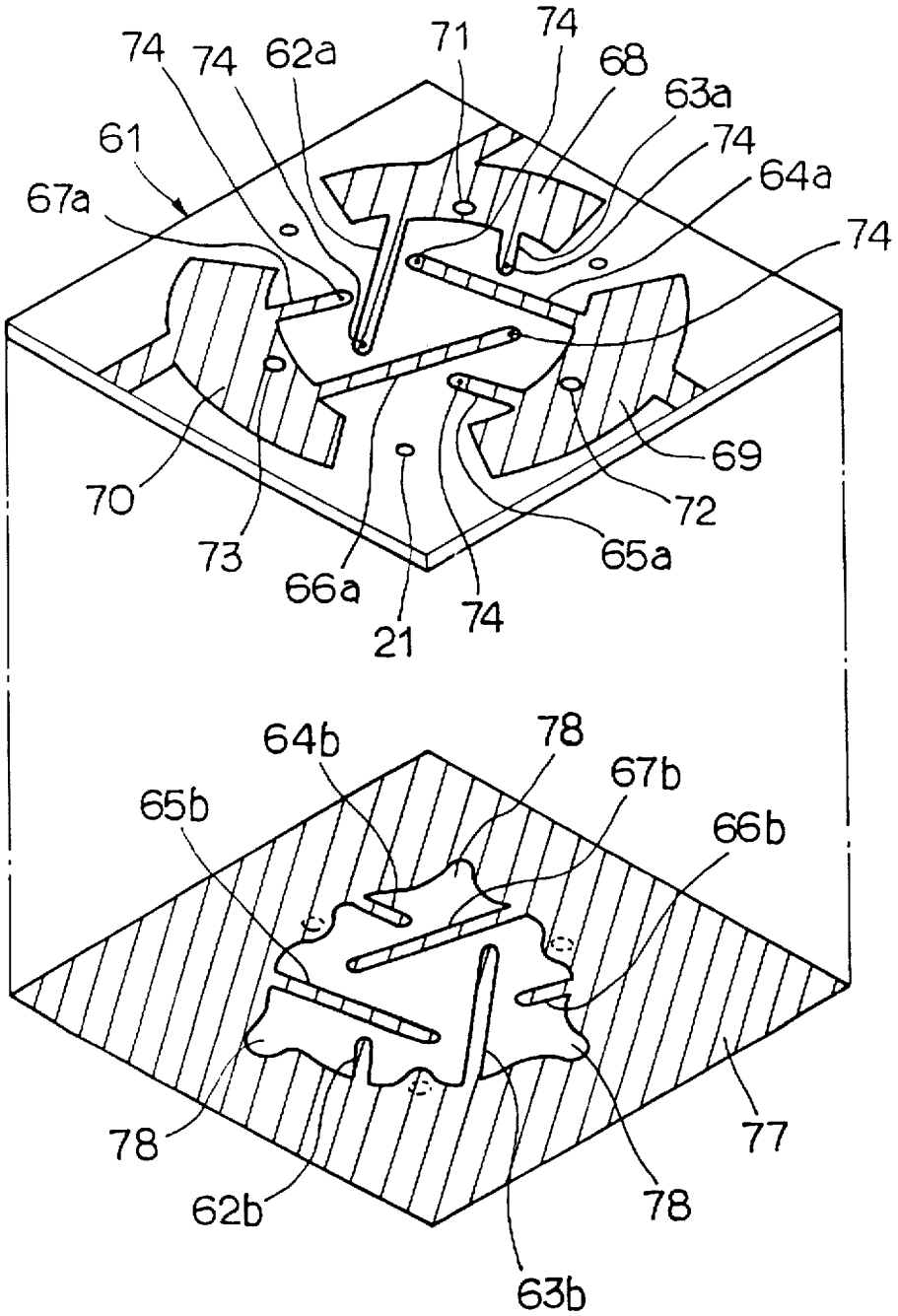
FIG. 7 is a perspective view for illustrating an essential part of a circulator according to a modification of the present invention.
Figure 8:
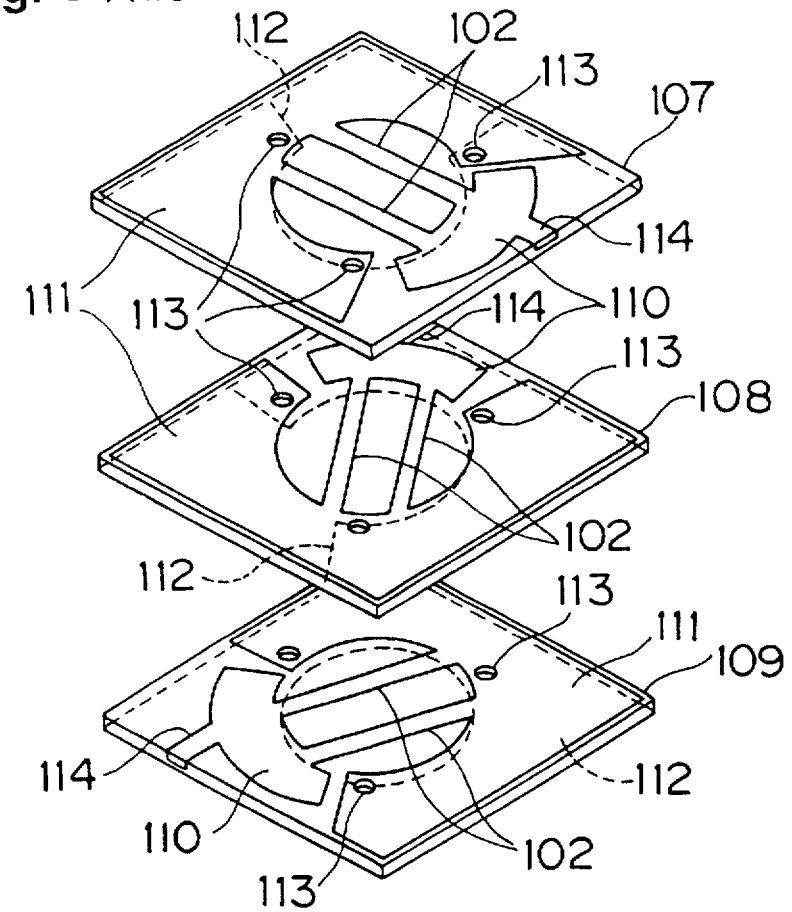
Fig. 8 PRIOR ART
FIG. 8 is an exploded perspective view showing the structure of a multilayer substrate forming a conventional circulator.
Figure 9:
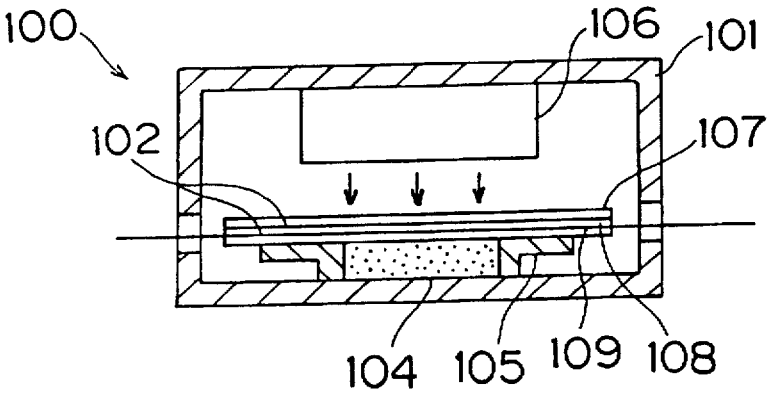
Fig. 9 PRIOR ART
FIG. 9 is a sectional view showing the structure of the conventional circulator.

A dielectric sheet 61 shown in FIG. 7 corresponds to a structure which is employed in place of the three fifth dielectric sheets 16 shown in FIG. 3.

First central electrode portions 62*a* to 67*a* are formed on a central region of an upper surface of the dielectric sheet 61. The six first central electrode portions 62*a* to 67*a* are classified into three groups each formed by a pair of first central electrode portions extending in parallel with each other. For example, the first central electrode portions 62*a* and 63*a* form a group, with the first central electrode portion 62*a* forming this group being increased in length as compared with the other first central electrode portion 63*a*.

Further, the pairs of first central electrode portions forming the respective groups are electrically connected to electrode portions 68 to 70 of sector shapes having lost central sides. In addition, the dielectric sheet 61 is provided with through-hole conductive portions 71 to 73. The through-hole conductive portions 71 to 73 are formed by filling up through holes with conductive materials. The electrode portions 68 to 70 are drawn out on a lower surface of the dielectric sheet 61 by the through-hole conductive portions 71 to 73.

Further, through-hole conductive portions 74 are formed on forward ends of the aforementioned plurality of first central electrode portions 62*a* to 67*a* respectively.

On the other hand, FIG. 7 shows electrode shapes on the lower surface in a downwardly projected manner, in order to clarify the electrode shapes on the lower surface. In the lower surface of the dielectric sheet 61, second central electrode portions 62*b* to 67*b* are formed in a center. The second central electrode portions 62*b* to 67*b* are electrically connected to corresponding first central electrode portions through the aforementioned through-hole conductive portions 74 respectively. For example, the second central electrode portion 62*b* is electrically connected with the first central electrode portion 62*a* provided on the upper surface side through the through-hole conductive portion 74, thereby forming a single central electrode. The remaining first and second central electrode portions are also electrically connected with each other through the through-hole conductive portions, thereby forming central electrodes respectively.

In the modification shown in FIG. 7, therefore, the respective central electrodes are formed on the upper and lower surfaces of the single dielectric sheet 61, with all of the plurality of central electrodes intersecting with each other in the central region of the dielectric sheet 61 being formed on the upper and lower surfaces of the single dielectric sheet 61. That is, the plurality of central electrodes are not separated by dielectric layers in a multilayer substrate as in the first and second embodiments.

Referring to FIG. 7, portions of the second central electrode portions 62*b* to 67*b* which are opposite to forward end portions connected to the through-hole conductive portions 74 are electrically connected to an earth electrode 77 which is formed in the periphery. The earth electrode 77 is provided with a plurality of notches 78 which are opened toward the central region. The respective notches 78 are provided for preventing electrical connection between the through-hole conductive portions 71 to 73, which are electrically connected with the electrode portions 68 to 70, and the earth electrode 77. The through-hole conductive portions 71 to 73 are electrically connected to the through-hole conductive portions 20 shown in FIG. 3. On the other hand, the earth electrode 77 is electrically connected to through-hole conductive portions 21 (see FIG. 3) which are arranged on a lower portion, as shown by broken circles.

While the aforementioned electrode structures are provided on the upper and lower surfaces of the single dielectric sheet 61 in FIG. 7, the electrode structure on the lower surface of the dielectric sheet 61 may be formed on an upper surface of another dielectric sheet which is arranged on the lower surface of the dielectric sheet 61. Namely, the electrode structures in this modification may be separately formed on a plurality of dielectric sheets, as long as the same are connected with each other by the through-hole conductive portions.

We claim:

1. A non-reciprocal circuit element, comprising:

a multilayer substrate having a plurality of dielectric layers stacked with each other, a plurality of central electrodes provided in said multilayer substrate, said central electrodes being electrically insulated from one another and intersecting one another, and at least one matching capacitance formed in said multilayer substrate: and a magnet and a ferrite body located on the same side of said central electrodes as one another with said ferrite body being located between said magnet and said central electrodes and being arranged relative to said magnet and said central electrodes to focus lines of magnetic force generated by said magnet onto said central electrodes in the area where said central electrodes intersect one another, said multilayer substrate including at least one opening for positioning said magnet and said ferrite body relative to said central electrodes, said at least one opening comprising a pair of openings which are contiguous with one another and of different size than one another, one of said openings receiving said magnet, the other of said openings receiving said ferrite body.

2. A non-reciprocal circuit element in accordance with claim 1, wherein said central electrodes have first central electrode portions being arranged on one surface of one of said dielectric layers, second central electrode portions being arranged on another surface, and through-hole conductive portions being formed in said one dielectric layer for electrically connecting said first and second central electrode portions with each other.

3. A non-reciprocal circuit element in accordance with claim 1, wherein an earth plate is located between said magnet and said ferrite body.

4. A non-reciprocal circuit element in accordance with claim 3, wherein said magnet, said earth plate and said ferrite plate are in physical contact with one another.

5. A non-reciprocal circuit element in accordance with claim 4, wherein said ferrite body and said magnet are in direct magnetic communication with one another.

6. A non-reciprocal circuit element in accordance with claim 1, wherein said central electrodes lie in respective planes which are parallel to and spaced from one another, said central electrodes intersect along a line which is perpendicular to said planes, and said magnet and ferrite body are generally planar and are positioned by said multilayer substrate in respective planes which are parallel to said planes in which said central electrodes lie.

7. A non-reciprocal circuit element in accordance with claim 6, wherein the size of said magnet and said ferrite body are different from one another as viewed along said planes and wherein each of said openings has a shape and size to accommodate a respective one of said magnet and ferrite body.

8. A non-reciprocal circuit element according to claim 1, wherein said matching capacitance comprises a plurality of capacitive parts each of which is formed by a respective one of said dielectric layers and a pair of capacitive electrodes being formed on upper and lower major surfaces of said respective dielectric layer to be opposed to each other, a plurality of said capacitive parts being connected to each said central electrode and being connected in parallel with each other to form said matching capacitance.

9. A non-reciprocal circuit element in accordance with claim 8, wherein said plurality of dielectric layers in said multilayer substrate are integrally co-fired dielectric layers being stacked with each other.

10. A non-reciprocal circuit element, comprising:

a multilayer substrate having a plurality of dielectric layers stacked with each other, a plurality of central electrodes provided in said multilayer substrate, said central electrodes being electrically insulated from one another and intersecting one another, and at least one matching capacitance formed in said multilayer substrate;

a first magnet and a first ferrite body located on the same side of said central electrodes as one another with said ferrite body being located between said magnet and said central electrodes and being arranged relative to said magnet and said central electrodes to focus lines of magnetic force generated by said magnet onto said central electrodes in the area where said central electrodes intersect one another; and a second magnet and a second ferrite body located on the same side of said central electrodes as one another but on the other side of said central electrodes relative to said first magnet and said first ferrite body, said second ferrite body being located between said second magnet and said central electrodes and being arranged relative to said second magnet and said central electrodes to focus lines of magnetic force generated by said second magnet onto said central electrodes in the area where said central electrodes intersect one another said multilayer substrate including a first pair of openings for positioning said first magnet and said first ferrite body relative to said central electrodes and a second pair of openings for positioning said second magnet and said second ferrite body relative to said central electrodes, said first pair of openings being contiguous with one another and said second pair of openings being contiguous with one another.

11. A non-reciprocal circuit element in accordance with claim 10, wherein said matching capacitance comprises a plurality of capacitive parts being stacked in said multilayer substrate and connected to each of said central electrodes, wherein each said capacitive part forming said matching capacitance is formed by a respective one of said dielectric layers and a pair of capacitive electrodes being formed on upper and lower major surfaces of said respective dielectric layer to be opposed to each other, a plurality of said capacitive parts being connected to each said central electrode and being connected in parallel with each other to form said matching capacitance.

12. A non-reciprocal circuit element in accordance with claim 11, wherein said matching capacitance is formed in a position offset from each said central electrode along the thickness of said multilayer substrate.

13. A non-reciprocal circuit element in accordance with claim 12, wherein each said capacitive part comprising said matching capacitance is formed on a position of each said dielectric layer, provided with each said central electrode, being different from that of said central electrode.

* * * * *